US008231474B2

(12) United States Patent
Stethem

(10) Patent No.: US 8,231,474 B2
(45) Date of Patent: Jul. 31, 2012

(54) MULTI-STIMULUS PERSONAL DEFENSE DEVICE

(75) Inventor: Kenneth J Stethem, Bellevue, ID (US)

(73) Assignee: Aegis Industries, Inc., Rockville, MD (US)

( * ) Notice: Subject to any disclaimer, the term of this patent is extended or adjusted under 35 U.S.C. 154(b) by 35 days.

(21) Appl. No.: 12/771,481

(22) Filed: Apr. 30, 2010

(65) Prior Publication Data

US 2010/0276514 A1 Nov. 4, 2010

Related U.S. Application Data

(60) Provisional application No. 61/174,227, filed on Apr. 30, 2009.

(51) Int. Cl.
*A63B 59/00* (2006.01)
*F41B 15/04* (2006.01)

(52) U.S. Cl. ..... 463/47.3; 463/47.4; 463/47.6

(58) Field of Classification Search ..... 463/47.2–47.7
See application file for complete search history.

(56) References Cited

U.S. PATENT DOCUMENTS

| | | | | |
|---|---|---|---|---|
| 291,242 | A | 1/1884 | Tower | |
| 427,549 | A | 5/1890 | Burton | |
| 1,158,473 | A | 11/1915 | Floyd | |
| 1,598,784 | A * | 9/1926 | Reynolds et al. | 42/1.08 |
| 1,823,407 | A | 9/1931 | Potter | |
| 1,986,682 | A | 1/1935 | Schulz | |
| 2,176,994 | A * | 10/1939 | Hansen et al. | 231/7 |
| 2,204,041 | A * | 6/1940 | Jefferson | 231/7 |
| 2,208,852 | A * | 7/1940 | Mongan | 231/7 |
| 769,880 | A | 9/1940 | Trouton et al. | |
| 2,253,315 | A | 8/1941 | Ardrus | |
| 2,266,606 | A | 12/1941 | Jones | |
| 2,561,122 | A | 7/1951 | Juergens | |
| 3,009,245 | A * | 11/1961 | Senkewitz | 30/155 |
| 3,362,711 | A * | 1/1968 | Larsen et al. | 463/47.3 |
| 3,385,601 | A | 5/1968 | Back | |
| 3,484,665 | A | 12/1969 | Ormsby | |
| 3,625,222 | A * | 12/1971 | Shimizu | 607/58 |
| 3,635,374 | A | 1/1972 | Anketell | |
| D230,150 | S | 1/1974 | Anderson | |
| 3,819,108 | A | 6/1974 | Jordan | |
| D243,261 | S | 2/1977 | Sartell | |
| 4,092,695 | A | 5/1978 | Henderson et al. | |

(Continued)

FOREIGN PATENT DOCUMENTS

DE 2723997 11/1978

(Continued)

OTHER PUBLICATIONS

International Search Report for International Application No. PCT/US2010/033185, mailed from the International Search Authority on Aug. 2, 2010, 5 pgs.

(Continued)

*Primary Examiner* — William Pierce
(74) *Attorney, Agent, or Firm* — Merchant & Gould P.C.

(57) ABSTRACT

A baton includes an elongate housing with a first compartment and a second compartment. A power source is located in the first compartment. An interchangeable operative component is located in the second compartment and may be removable/replaceable. The interchangeable operative component may be a training module, a light source, a laser generator, a sound generator, an incapacitation waveform generator, and combinations thereof.

12 Claims, 16 Drawing Sheets

U.S. PATENT DOCUMENTS

D255,139 S 5/1980 Smith
4,203,599 A 5/1980 Starrett
4,424,932 A 1/1984 Allen
D273,216 S 3/1984 Sinrod
4,479,171 A * 10/1984 Mains ..... 362/102
4,486,807 A 12/1984 Yanez
D277,596 S 2/1985 Nishiuchi
4,522,398 A 6/1985 Swartz et al.
D282,863 S 3/1986 Kashary, Jr.
D289,313 S 4/1987 Shy
4,667,431 A 5/1987 Mendicino
4,667,958 A 5/1987 Raitto
4,719,534 A 1/1988 Ward
4,739,990 A 4/1988 Aguirre et al.
D300,838 S 4/1989 Smith, Sr.
4,842,277 A * 6/1989 LaCroix ..... 463/47.3
4,852,454 A 8/1989 Batchelder
4,949,966 A 8/1990 Bopp
4,964,636 A * 10/1990 Ashihara ..... 463/47.4
4,968,034 A 11/1990 Hsieh et al.
D315,391 S 3/1991 Fabrey
D315,392 S 3/1991 Lew
5,041,951 A 8/1991 Fan et al.
5,060,123 A 10/1991 Arnold
5,085,433 A * 2/1992 Parsons ..... 463/47.6
5,086,377 A * 2/1992 Roberts ..... 362/102
5,108,098 A 4/1992 Ashihara et al.
D329,510 S 9/1992 Lin et al.
5,153,365 A 10/1992 Chang et al.
5,160,140 A 11/1992 Starrett
D333,692 S 3/1993 Parsons
D333,693 S 3/1993 Parsons
5,192,074 A 3/1993 Ashihara
5,193,048 A 3/1993 Kaufman et al.
5,197,734 A 3/1993 Ashihara et al.
D334,790 S 4/1993 Jaramillo
5,287,255 A * 2/1994 Strodtman ..... 362/102
5,320,348 A 6/1994 Starrett
5,320,349 A 6/1994 Winston
D348,771 S 7/1994 Barnes
5,347,436 A 9/1994 Clyde et al.
5,348,296 A 9/1994 Frederiksen
D351,640 S 10/1994 de Anda et al.
5,363,285 A * 11/1994 Wideman ..... 362/102
5,405,134 A * 4/1995 Wolfram ..... 463/47.4
5,407,197 A 4/1995 Parsons
D359,338 S 6/1995 Starrett
D360,007 S 7/1995 Farr
5,465,960 A * 11/1995 Bickerton et al. ..... 463/47.6
5,467,247 A 11/1995 de Anda et al.
D365,622 S 12/1995 Edwards
D370,276 S 5/1996 Davis
5,529,300 A 6/1996 Frazier et al.
5,654,867 A 8/1997 Murray
5,698,815 A 12/1997 Ragner
D391,336 S 2/1998 Cecilio
D395,069 S 6/1998 Starrett
D401,374 S 11/1998 Lum
5,829,643 A 11/1998 Isabella
5,839,461 A 11/1998 Lambeth, Jr.
5,842,601 A 12/1998 Pierpoint
5,842,602 A * 12/1998 Pierpoint ..... 222/1
D404,789 S 1/1999 Starrett
5,962,806 A 10/1999 Coakley et al.
5,986,872 A 11/1999 Chaput
D418,617 S 1/2000 Parsons
6,022,120 A 2/2000 Chang et al.
D421,503 S 3/2000 Parsons
6,091,597 A 7/2000 Lin et al.
D435,888 S 1/2001 Iyoob
6,196,921 B1 3/2001 Larson
D440,273 S 4/2001 Hindi
6,256,916 B1 7/2001 McNulty
6,293,684 B1 9/2001 Riblett
D450,451 S 11/2001 Starrett
D452,545 S 12/2001 Starrett
6,386,726 B1 * 5/2002 Macierowski et al. ..... 362/102
D464,367 S 10/2002 Conrad
D467,828 S 12/2002 Jones
6,499,855 B1 12/2002 Kukuk
6,546,661 B1 4/2003 Staubs
D474,827 S 5/2003 Todd et al.
D479,298 S 9/2003 Parsons
6,615,622 B2 9/2003 MacAleese et al.
6,636,412 B2 10/2003 Smith
6,643,114 B2 * 11/2003 Stethem ..... 361/232
D483,432 S 12/2003 Parsons
6,658,779 B2 12/2003 Bauer et al.
6,675,073 B2 1/2004 Kieman et al.
D487,629 S 3/2004 Parsons et al.
6,761,639 B2 * 7/2004 Todd ..... 463/47.2
6,791,816 B2 * 9/2004 Stethem ..... 361/232
6,807,762 B1 10/2004 Edwards
6,877,434 B1 4/2005 McNulty, Jr.
6,880,466 B2 4/2005 Carman
D504,712 S 5/2005 Powell et al.
6,898,887 B1 5/2005 Stratbucker
6,922,931 B2 8/2005 Bauer et al.
6,999,295 B2 2/2006 Watkins, III et al.
7,000,807 B2 2/2006 Cellini et al.
7,004,597 B2 * 2/2006 Kukuk ..... 362/102
D517,154 S 3/2006 Otto
7,029,397 B1 4/2006 Barwick
D520,593 S 5/2006 Anderson
D520,733 S 5/2006 Siteman
7,044,858 B1 5/2006 Otto et al.
7,102,870 B2 9/2006 Nerheim
D532,859 S 11/2006 Stethem
7,158,362 B2 1/2007 Smith
7,211,001 B2 5/2007 Motyka et al.
7,524,076 B2 * 4/2009 Kukuk ..... 362/112
D618,757 S 6/2010 Stethem
7,736,237 B2 * 6/2010 Stethem et al. ..... 463/47.3
7,744,471 B2 * 6/2010 Parsons ..... 463/47.4
2002/0163799 A1 11/2002 Kukuk
2002/0170418 A1 11/2002 McNulty Jr. et al.
2003/0139215 A1 7/2003 Todd
2003/0165041 A1 9/2003 Stethem
2003/0165042 A1 9/2003 Stethem
2004/0065310 A1 4/2004 Masse
2004/0137988 A1 * 7/2004 Parsons ..... 463/47.2
2004/0156163 A1 8/2004 Nerheim
2005/0037847 A1 * 2/2005 Pickens, Jr. ..... 463/47.2
2005/0039628 A1 2/2005 Carman
2005/0043101 A1 2/2005 Knapp
2005/0073796 A1 4/2005 Smith et al.
2005/0073798 A1 4/2005 Stethem
2005/0152087 A2 7/2005 Smith et al.
2005/0188888 A1 9/2005 Watkins et al.
2007/0045346 A1 3/2007 Siteman
2007/0079538 A1 4/2007 Smith et al.
2007/0167241 A1 * 7/2007 Stethem et al. ..... 463/47.3
2007/0238532 A1 * 10/2007 Stethem ..... 463/47.2
2008/0010888 A1 1/2008 Nerheim
2008/0020850 A1 1/2008 Stethem
2008/0130193 A1 6/2008 Nerheim
2009/0064979 A1 * 3/2009 Andrews ..... 124/65
2010/0214714 A1 8/2010 Stethem et al.
2010/0276514 A1 11/2010 Stethem
2010/0304874 A1 * 12/2010 Abatemarco ..... 463/47.3

FOREIGN PATENT DOCUMENTS

DE 20212940 12/2002
EP 0378750 7/1990
GB 2196728 5/1988
NL 6816116 5/1970
WO WO 03075426 9/2003

OTHER PUBLICATIONS

Monadnock Lifetime Products, Inc., "PR-24® Specification," (1 pg.), undated.
"Monadnock 36" Thermoplastic Grenade Grip Straight Baton," website: http://www.copsplus.com/prodnum5507.php, (5 pgs.), accessed Oct. 23, 2006.
"Monadnock 24" Monpac Baton Night Stick," website: http://www.copsplus.com/prodnum1607.php, (5 pgs.), accessed Oct. 23, 2006.

"Casco CP-24 24" Straight Polycarbonate Baton," website: http://www.copsplus.com/prodnum2566.php, (5 pgs.), accessed Oct. 23, 2006.
"Casco 18" to 26" Straight Acetate Baton," website: http://www.copsplus.com/prodnum2571.php, (5 pgs.), accessed Oct. 23, 2006.
Monadnock Lifetime Products, Inc., "PR-24 Control Baton® Benefits," website: http://www.batons.com/pr/ben.htm, (2 pgs.), accessed Oct. 23, 2006.
Monadnock Lifetime Products, Inc., "PR-24 Control Baton® Functions," website: http://www.batons.com/pr/fun.htm, (1 pg.), accessed Oct. 23, 2006.
Monadnock Lifetime Products, Inc., "PRr-24 Control Baton® Specifications," website: http://www.batons.com/pr/spec.htm, (2 pgs.), accessed Oct. 23, 2006
Monadnock Lifetime Products, Inc., "PR-24 Control Baton®," website: http://www.batons.com/pr/index.htm, (2 pgs.), accessed Oct. 23, 2006.
"Monadnock Model PR-24STS 24"8 Polycarbonate Control Baton," website: http://www.copsplus.com/produm1593.php, (5 pgs.), accessed Oct. 23, 2006.

* cited by examiner

MULTI-STIMULUS PERSONAL DEFENSE DEVICE

CROSS-REFERENCE TO RELATED APPLICATION

This application claims priority to and the benefit of U.S. Provisional Patent Application No. 61/174,227, filed Apr. 30, 2009, the disclosure of which is hereby incorporated by reference herein in its entirety.

FIELD OF THE INVENTION

This invention relates generally to personal defense devices and, more specifically, to personal defense devices that incorporate multiple force options, to reduce the separate pieces of equipment that a law enforcement officer must carry.

BACKGROUND

Personal defense devices, such as batons, are generally used by law enforcement officers as striking, close-quarter weapons. In addition to these batons, officers must generally carry additional devices in the field, so as to have a full spectrum of offensive and defensive weapons. Additional devices include, for example, high-intensity lights, electric waveform generators (e.g., stun devices), chemical spray (e.g., pepper spray) discharge devices, etc. These devices, in addition to typical duty items such as flashlights, radios, restraints, etc., increase the equipment a fully equipped officer must carry. An officer's mobility and agility may be hindered by the weight associated with carrying a number of devices on his or her duty belt. Additionally, it may be difficult for an officer to switch devices quickly as a threatening situation evolves, thus requiring a change in force strategy and device deployment. These issues are not limited law enforcement officers. Military forces, especially those that rely on stealth and speed (such as special operations forces) must be particularly judicious in choosing equipment to carry into the field.

SUMMARY OF THE INVENTION

In one aspect, the invention relates to a baton having an elongate housing including a proximal end and a distal end, the housing defining a first compartment located proximate the proximal end and a second compartment located proximate the distal end, and a power source located in the first compartment, wherein the second compartment is adapted to removably receive interchangeably an operative component selected from the group consisting of a training module, a light source, a laser generator, a sound generator, an electromuscular incapacitation waveform generator, and combinations thereof.

In one embodiment of the above aspect, the baton includes an electrical connection from the first compartment to the second compartment. In another embodiment, power source is connected to the electrical connection and the operative component comprises a contact for contacting the electrical connection. In yet another embodiment, wherein the operative component includes means for converting an electrical output from the power source to an electrical input for the operative component. In still another embodiment, the operative component comprises a connection element to secure the operative component within the second compartment. In another embodiment, the connection element is secured with a fastener, wherein the fastener is accessed from the first compartment.

In an embodiment of the above aspect, the baton includes a removable cap on the distal end, wherein removal of the cap provides access to the power source. In another embodiment, the cap has a control button for controlling the operative component. In yet another embodiment, the baton includes a handle substantially orthogonal to the elongate housing, handle having a handle housing, a cap secured to a top of the handle housing, and a spray deterrent canister located within the handle housing and substantially covered by the cap.

In another aspect, the invention relates to a baton having an elongate member having a housing including a proximal end and a distal end and defining a first chamber located proximate the proximal end, the first chamber adapted to receive a power source, and defining a second chamber located proximate the distal end, the second chamber adapted to receive an operative component, and a control element located proximate the proximal end, the control element adapted to control the operative component, and a handle secured to the elongate element and including a housing, a cap secured to a top of the housing, and a spray deterrent canister located within the housing and substantially covered by the cap.

In an embodiment of the above aspect, the elongate member further includes a divider separating the first chamber and the second chamber, an electrical connection through the divider, and an operative component selected from the group consisting of a training module, a light source, a laser generator, a sound generator, an electromuscular incapacitation waveform generator, and combinations thereof. In another embodiment, the baton further includes a pivotable connection for connecting the elongate member to the handle. In yet another embodiment, the elongate member further defines a recess for receiving at least a portion of the handle when the handle is in a stored position. In still another embodiment, the pivotable connection has a track defined by the elongate element and a movable guide received at least partially within the track and the handle. In another embodiment, the elongate member further includes a locking element to secure the handle in a deployed position.

In another aspect, the invention relates to a baton having an elongate member having a housing having an axis, a proximal end, and a distal end; an electric waveform generator located at least partially within the housing; at least one discharge electrode located proximate the distal end and operatively connected to the electric waveform generator; and a control element located proximate the proximal end, the control element adapted to control the electric waveform generator; and a handle substantially orthogonal to the elongate member, the handle including a housing; a cap secured to a top of the housing; and a spray deterrent canister located within the housing and substantially covered by the cap, the spray deterrent canister containing a non-flammable spray deterrent.

In an embodiment of the above aspect, the elongate member further includes a light proximate the distal end. In another embodiment, the light includes at least one of a constant beam and a strobe. In another embodiment, the elongate member further includes a laser proximate the distal end. In yet another embodiment, the electric waveform generator includes a circuit for generating a pulsed, low-power electric waveform having a frequency and over a time period sufficient to induce involuntary muscular contraction with non-injurious muscle effects. In still another embodiment, the cap includes a pivotable guard. In certain embodiments, the guard is pivotable between a first position and a second position. In another embodiment, the spray deterrent canister includes an actuator for discharging a spray deterrent from the canister.

In an embodiment of the above aspect, the canister is oriented such that a direction of spray discharge is substantially parallel to the axis of the elongate member and toward the distal end of the elongate member. In another embodiment, when in the first position, the guard substantially prevents access to the actuator by a user, and when in the second position, the guard permits access to the actuator by a user. In another embodiment, the baton further includes a stop arranged for contact with the guard, wherein the stop prevents actuation of the actuator by the guard. In another embodiment, a discharge pattern of the spray deterrent is a stream. In yet another embodiment, the discharge pattern of the spray deterrent does not contact the electrodes. In still another embodiment, the control element includes at least one of a switch, a button, a toggle, and a dial. In another embodiment, the baton further includes a lanyard attached to at least one of the elongate member and the handle.

In another aspect, the invention relates to a method of installing a spray deterrent canister in a handle of a baton including the steps of providing a baton having an elongate member, a handle substantially orthogonal to the elongate member, the handle having a housing, and a cap secured to an end of the housing opposite the elongate member; detaching the cap from the end of the housing; inserting a spray deterrent canister into the housing; and attaching the cap to the end of the housing. In an embodiment of the above aspect, the method includes the step of removing a used spray deterrent canister from the hollow housing.

BRIEF DESCRIPTION OF THE FIGURES

Other features and advantages of the present invention, as well as the invention itself, can be more fully understood from the following description of the various embodiments, when read together with the accompanying drawings, in which.

DETAILED DESCRIPTION

Figure 1:
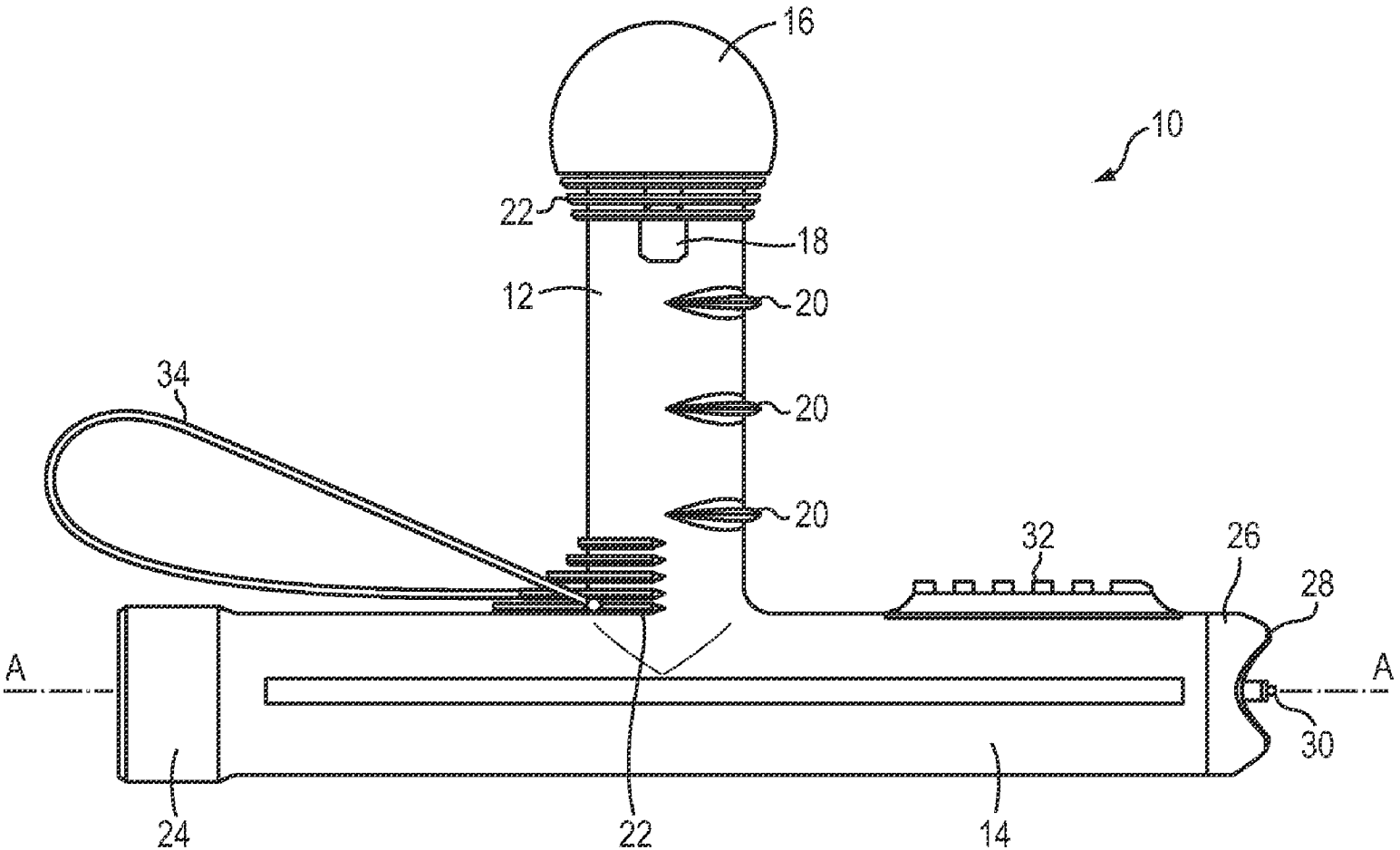
FIG. 1 is a side elevational view of a baton in accordance with one embodiment of the present invention.
Figure 2:
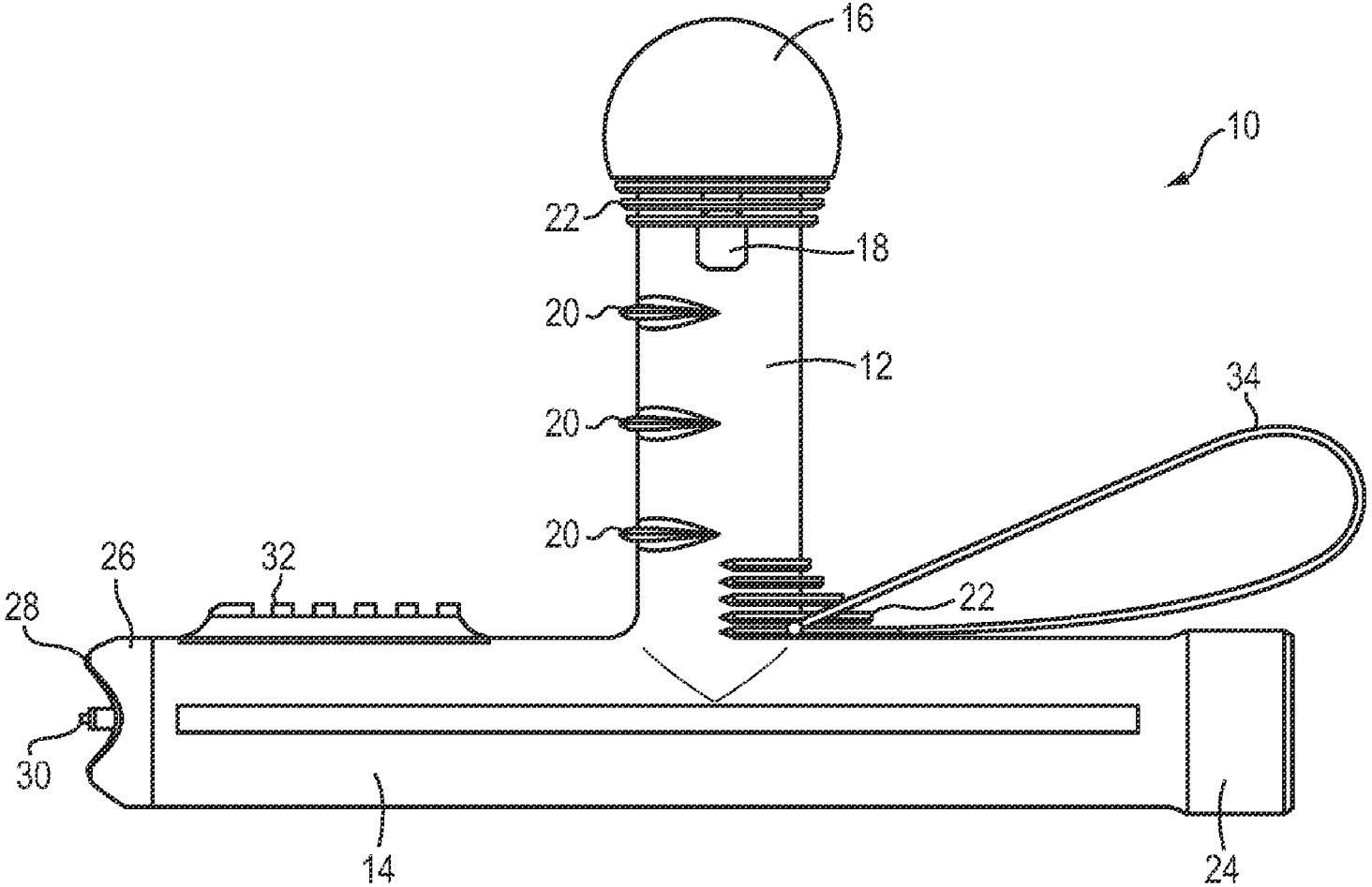
FIG. 2 is an opposite side elevational view of the baton in accordance with one embodiment of the present invention.

Much of the expense associated with known personal defense devices results from their highly specialized construction. For example, batons designed for military use may include devices and deterrents that are unnecessary or even dangerous for law enforcement or civilian use. In that case, specialized batons must be manufactured for each group (and even subgroups, i.e., special military operations versus combat troops versus military police). This increases the manufacturing costs of such batons, making them only practical for very specific operations or users. Accordingly, the baton of the present inventions utilizes modular construction to increase the versatility of the baton. Different operative components (e.g., electric waveform generators, high-intensity lights, sound generators, infrared lights, strobe lights, combinations thereof, etc.) may be added or removed from the baton, depending on the particular application. Thus, a single baton housing may be used across a wide range of applications while reducing costs.

In addition to modularity, the baton described herein exhibits further advantages over prior art batons that include multiple deterrents. Some prior art batons include telescoping portions that extend from an end of the baton opposite the end containing the lights and electrodes. Such a telescoping portion increases the length of the baton and allows for use of the baton as a striking weapon having increased reach. Extending these portions, however, generally requires holding the baton by the non-telescoping end and whipping the baton quickly to extend the telescoping portions. Gripping a baton by the non-telescoping end, however, points the operational end (i.e., the end from which the spray deterrent and electric waveform are emitted) toward the user, which increases the chance of one or more of the deterrents being directed at the user, instead of a subject.

In one embodiment, the baton is formed as a generally inseparable assembly, with the internal components (described below) located therein. The baton disclosed herein can be deployed and configured in a variety of different forms. Shown in the drawings and described herein below in detail are various embodiments and features of the invention. It is to be understood that the present disclosure is an exemplification of the principles of the invention and does not limit the invention to the illustrated embodiments.

Referring to the drawings, FIGS. 1-7, show various views of a baton 10 with a handle 12 and an elongate member 14 or shaft defining an axis A. The handle 12 may be integrally molded with the shaft 14, chemically bonded to the shaft 14, detachable with a simple twisting motion (e.g., a thread or a bayonet retention style fitting), or can be attached mechanically, for example by a set screw, bolt, pin, etc. One exemplary mechanical attachment mechanism is described in FIGS. 13A-14. The handle 12 may be topped with a cap 16, as described in more detail below. The cap 16 may be secured to the handle 12 with one or more quick release connections 18. Alternatively, the cap 16 may be attached via a screw/thread connection, press-fit, or other type of connection. The handle 12 may include one or more finger contours 20 to generally match the gaps between fingers of a human hand as a user grips the handle. Additionally, one or more raised surfaces 22 further match the shape of the human hand. These contours 20 and raised surfaces 22 can help improve a user's grip on the handle 12 and, accordingly, operation of the baton 10.

A control end 24 of the shaft 14 provides access to a number of buttons, switches, toggles, or dials (described in more detail below). In general, this control end 24 faces a user during use or deployment of the baton 10. An operational end 26 of the shaft 14 includes, in one embodiment, a contoured shape 28, which may be used as a blunt-force implement or as an implement to turn out a pocket of a subject. This turn-out function is described in U.S. Patent Application Publication No. 2008/0020850, the disclosure of which is hereby incorporated by reference herein in its entirety. The operational end 26 may also include one or more electrode contacts 30, which may deliver an electric waveform to a target, as described below. Alternatively, the control end 24 and operational end 26 of the shaft 14 may be shaped as desired for particular applications. Any combination of end geometries may be used. Exemplary end geometries are described and depicted in U.S. Patent Application Publication No. 2008/0020850. Additionally, a picatinny rail 32 or other device may also be included on the shaft 14 to allow for attachment of equipment, such as laser pointers, cameras, thermal image cameras, lights, sound generators, etc. Certain embodiments of the baton are sized to accept lights currently manufactured for use on pistols and other hand-held firearms. In other embodiments, a picatinny rail adapter may be installed on an underside of the elongate member (i.e., on the side opposite the handle) so the baton may be attached directly to a picatinny rail present on a rifle or other firearm. A lanyard 34 may be connected to either the elongate member 14 or handle 12, or at a location proximate the connection point of both. The lanyard 34 may help the user to retain control of the baton 10 during use.

Figure 3:
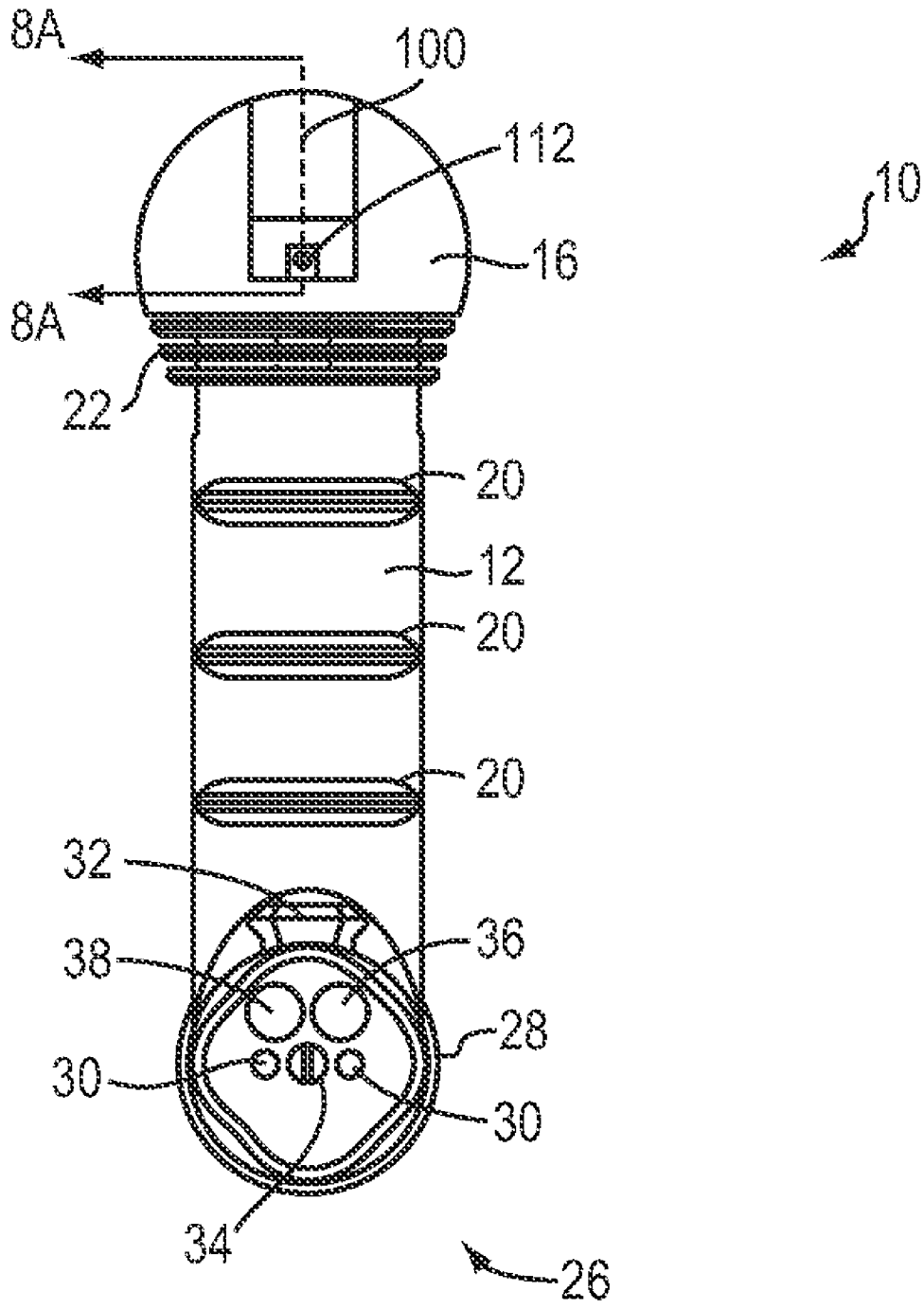
FIG. 3 is a first end elevational view of the baton in accordance with one embodiment of the present invention.

FIG. 3 depicts an end view of the operational end 26 of the baton 10. The operational end 26 of the baton 10 includes one or more electrode contacts 30 for delivering an electric waveform to a subject. Other deterrent or functional elements may be incorporated into the operational end 26 of the baton. For example, a high intensity laser emitter 34 may be incorporated. Such laser emitters may be used for visual deterrent and/or marking targets for laser target designating operations. The laser emitter can be utilized when the baton 10 is used in a law enforcement or military application (e.g., by a strike team on reconnaissance missions). Additional functional elements include a flashlight 36 (which generally may have a wider beam dispersion than the high-intensity laser 34) and/or a strobe-light 38. Both the flashlight 36 and strobe light 38 may utilize light-emitting diodes (LEDs) or other shock-resistant light-generating elements. Additionally, the flashlight 36 and strobe light 38 may be combined into a single component, with appropriate controls and switches (described below) to cycle between constant beam and strobe settings. In general, it is desirable for certain of the components on the operational end 26 to be recessed below the edge of the contoured shape 28, to prevent possible damage to the components when the baton is used as a striking weapon. Note that the electrode contacts 30 should project a sufficient distance beyond the edge of the contoured shape 28 to contact a subject when the waveform generator is energized, so that a waveform can be discharged against the subject. In other embodiments, an audible deterrent element (e.g., a directed sonic weapon, high-pitch speaker, etc.) may be utilized.

Figure 8A:
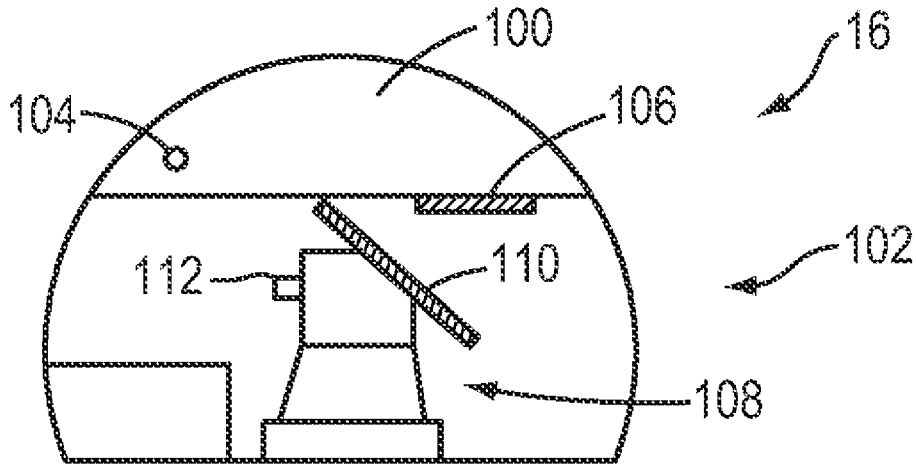
FIGS. 8A and 8B are side sectional views of a cover of the baton in accordance with one embodiment of the present invention.
Figure 8B:
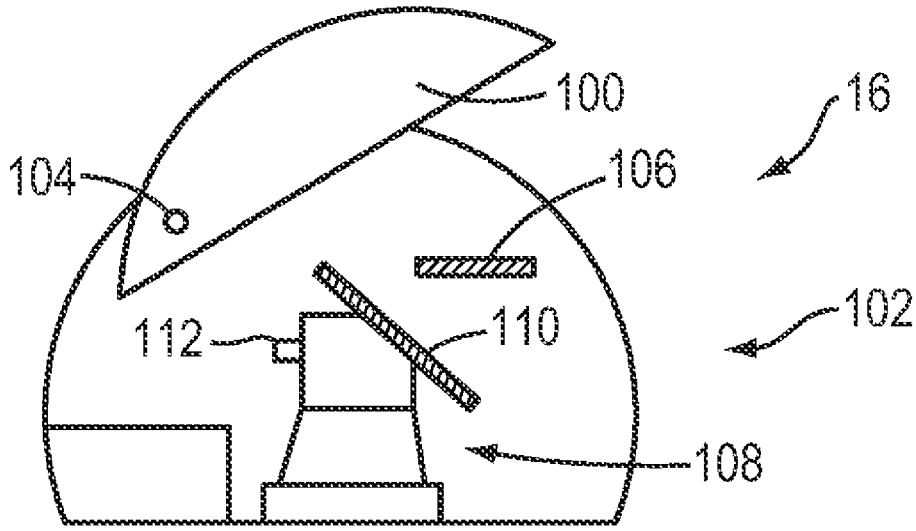

The cap 16, in addition to forming another surface with which to strike a subject, includes a pivotable guard 100 which may be pivoted by the user to access an actuator for a pepper, chemical, or other spray deterrent contained within a canister in the hollow handle 12. The details of this guard 100 are shown in FIGS. 8A and 8B, which depict the spray deterrent mechanism 102 in the non-deployable and deployable positions, respectively. In the non-deployable position, the guard 100 is supported by a pivot pin 104 at a first end and one or more stops 106 at or near a second end. A top portion of a spray deterrent canister (not shown completely) contained within the handle 12 projects into the internal space 108 of the cap 16. The top portion of the canister includes an actuator 110 and a discharge nozzle 112, from which a spray deterrent may be discharged, by pressing the actuator 110.

The guard 100 is configured and supported by a pivot pin 104 and the stop 106, such that a blow to the top of the guard 100 will not cause inadvertent actuation and discharge of the spray deterrent. The discharge nozzle 112 faces in the same general direction as the operational end 26 of the baton 10. Accordingly, during use, all deterrent options face toward a subject, which helps prevent inadvertent activation of any of the deterrents toward the user. Returning to FIG. 8A, in the first, non-deployable position, the actuator 110 is not accessible by the user of the device. By lifting the guard 100 to the second, raised position depicted in FIG. 8B, the actuator 110 may be accessed, for example by the user's thumb. The guard 100 may simply be lifted with a thumb or finger as needed during use. Once the thumb is removed from the actuator 110 after discharge, the guard 100 returns to its original lowered position by spring action, or may be held in the raised position by a bi-stable or other mechanism. Other guard configurations are depicted in U.S. Pat. No. 7,121,434, the disclosure of which is hereby incorporated by reference herein in its entirety.

Figure 4:
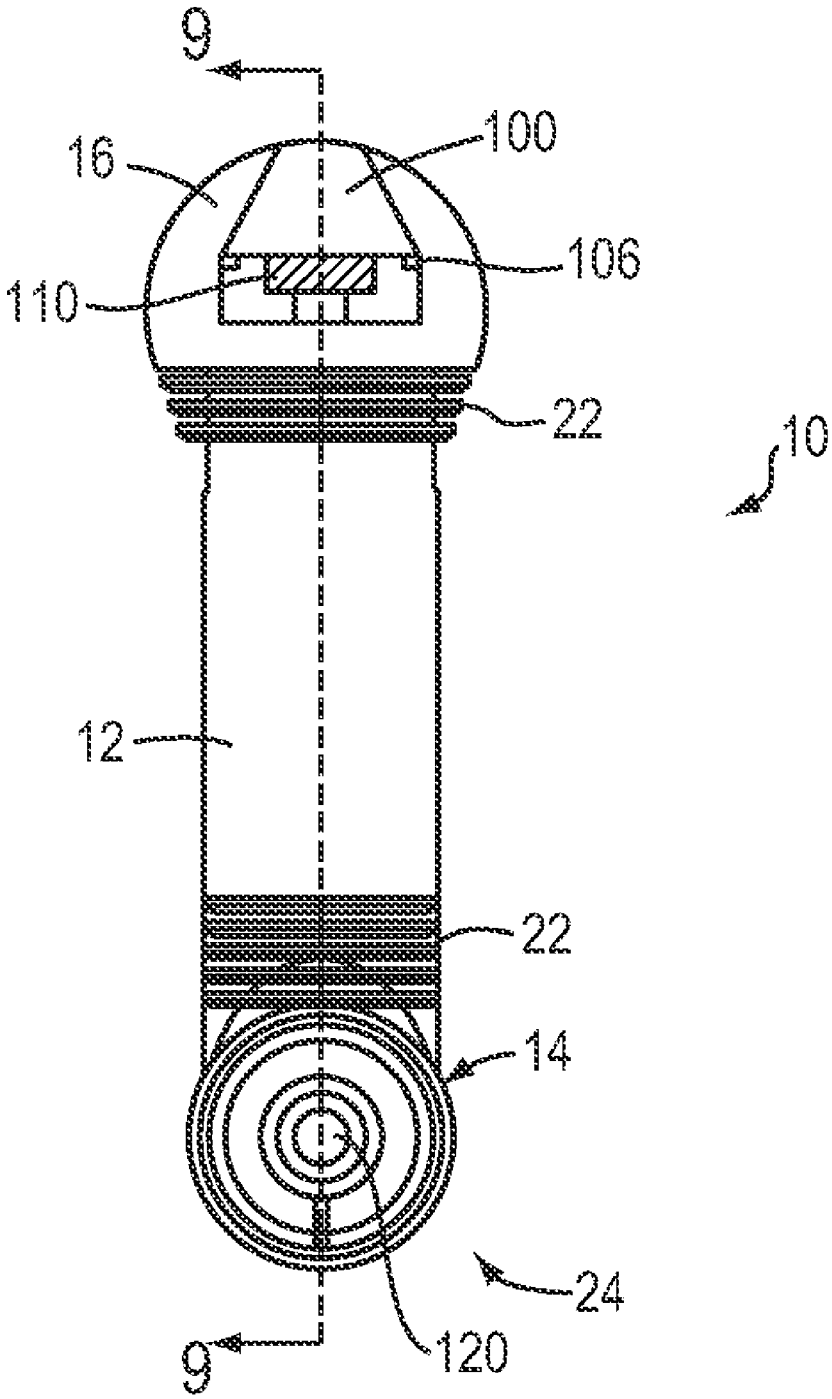
FIG. 4 is a second end elevational view of the baton in accordance with one embodiment of the present invention.
Figure 5:
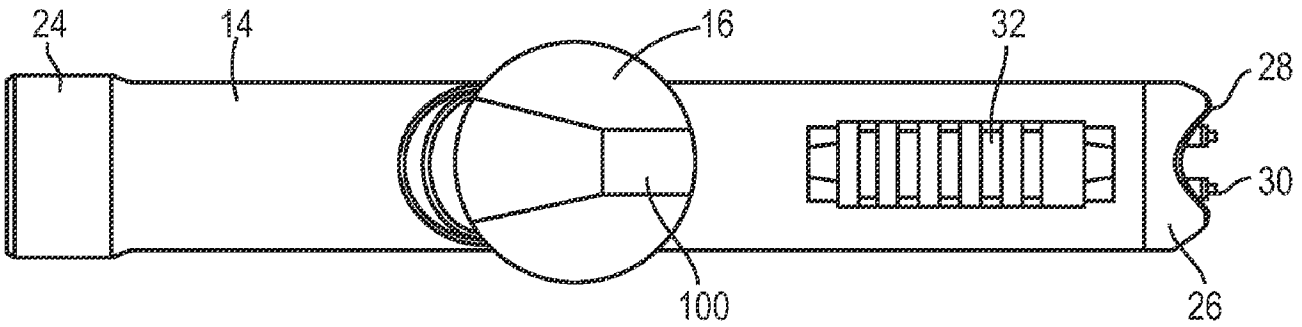
FIG. 5 is a top plan view of the baton in accordance with one embodiment of the present invention.
Figure 6:
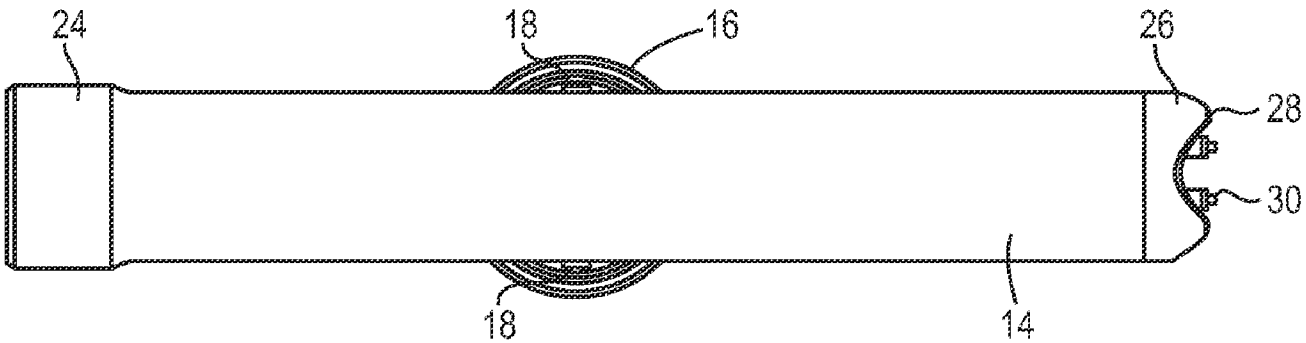
FIG. 6 is a bottom plan view of the baton in accordance with one embodiment of the present invention.
Figure 7:
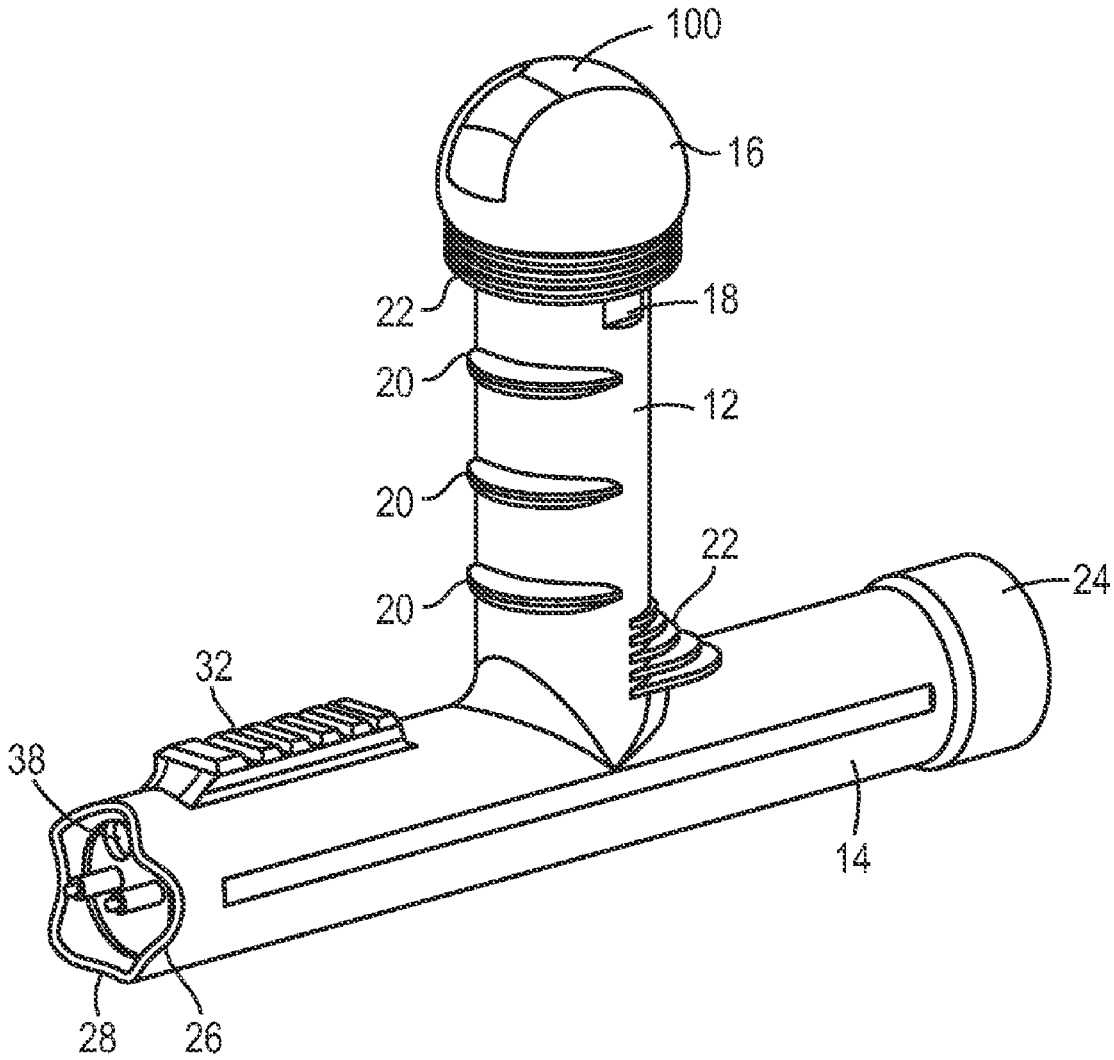
FIG. 7 is a schematic perspective view of the baton in accordance with one embodiment of the present invention.

FIG. 4 depicts the baton 10, as viewed from the control end 24 of the shaft 14. The control end 24 may include one or more control elements 120, such as buttons, switches, toggles, dials, etc., to control the various deterrents and components located on the operational end 26 of the baton 10. By locating the buttons 120 on the end of the shaft 14 closest to the user, the likelihood of activation of any of the buttons 120 by a subject is reduced. In certain embodiments of the baton, one button may control both the beam and strobe function of the light. Other embodiments of the baton include a four-direction switch to control, for example, the strobe, the beam, the laser, and the waveform generator. Other control elements are also contemplated.

FIG. 4 also depicts the movable cover 100 located on the cap 16. As can be seen in FIG. 4, the movable cover 100 is located in the first lowered, non-deployable position, as depicted in FIG. 8A. While the actuator 110 of the spray deterrent canister may be partially visible, access is effectively blocked and it may not be actuated by the baton user until the moveable cover is moved to the second raised, deployable position, as depicted in FIG. 8B.

Figure 9:
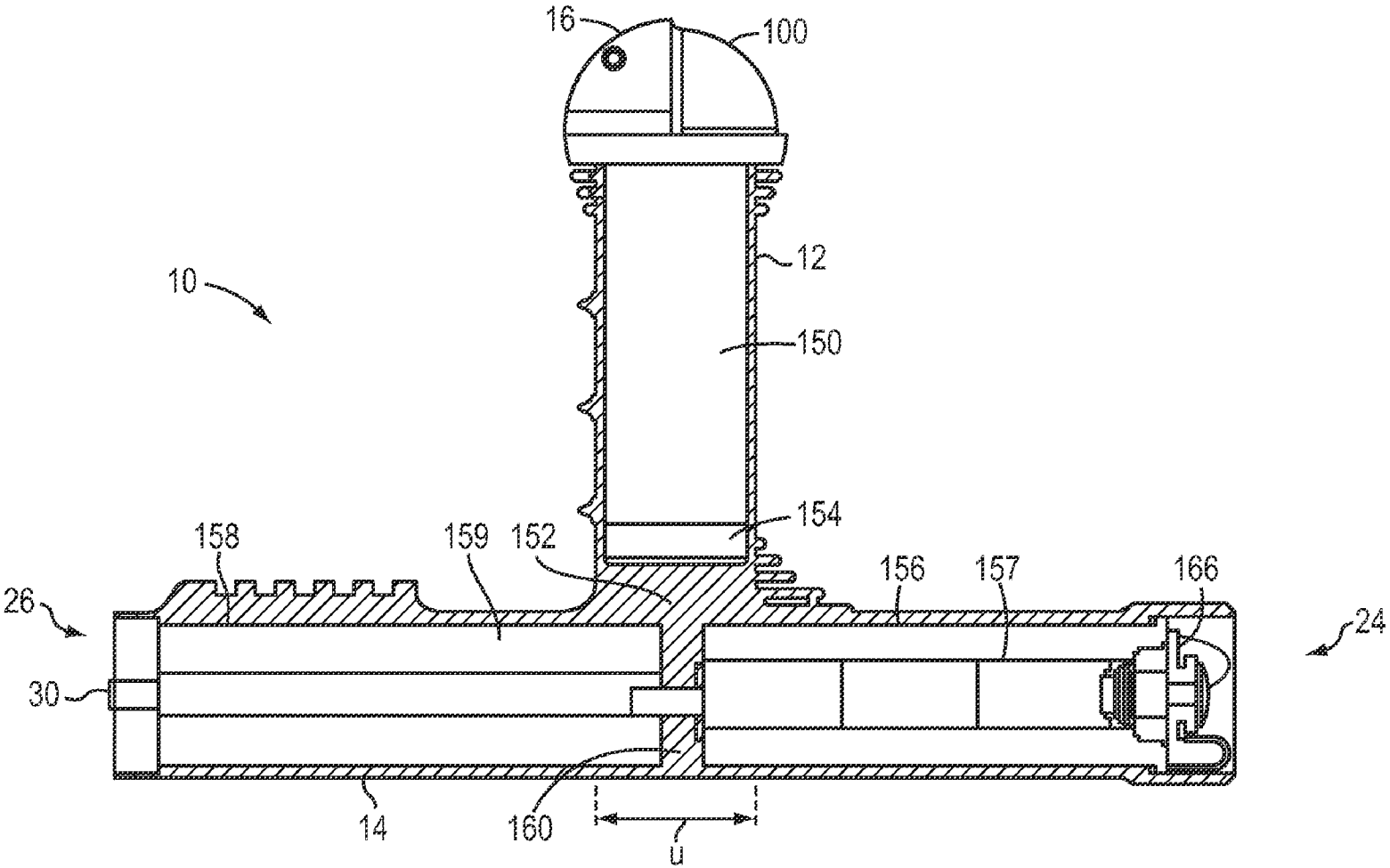
FIG. 9 is a side sectional view of the baton in accordance with one embodiment of the present invention.

FIG. 9 depicts a sectional side view of one embodiment of the baton 10, including various internal components. At least partially contained within the handle 12 is a spray deterrent canister 150, as described above. The canister 150 is inserted into the handle by removing the cap 16, removing a spent canister (if present), inserting a new canister, and replacing the cap 16. In other embodiments of the spray deterrent system, such as those depicted in U.S. Pat. No. 7,121,434, the spray deterrent canister is fixed to the cap, such that removal of the cap removes the canister. A solid structural element or seal 152 may be provided to separate an interior void 154 of the handle 12 from a first compartment or chamber 156 and a second compartment or chamber 158 of the elongate member 14. Use of a solid structural element increases strength and rigidity at the handle/elongate member interface. Both the solid element and the seal 152 prevent moisture (either in the form of water or spray deterrent), from entering the chambers 156, 158 of the elongate member 14. Such an introduction of moisture may damage the electrical components contained therein. Existing baton devices that incorporate spray deterrents may require insertion of the deterrent canister from an underside the device (identified as U in FIG. 9). Batons configured to require insertion from the underside U have structural shortcomings that the present configuration obviates. First, since the elongate member 14 of the device is typically used for striking or exerting force against a subject, it is important to maintain an uninterrupted outer surface to maintain structural rigidity of the elongate member to prevent failure. Second, insertion of a canister from the underside U requires extreme care, so as not to actuate inadvertently the actuator (and discharge the canister). Inadvertent actuation may occur by contacting the actuator to the elongate member during insertion, or an end stop in the handle. Last, insertion of a canister from a top of the handle in accordance with the invention allows for simplified alignment of the discharge nozzle with the operational end 26.

In the embodiment depicted in FIG. 9, the first chamber 156 is configured to contain a power source 157 (e.g., a rechargeable or standard battery) for powering the operative component 159 located in the second chamber 158. Embodiments of both the power source 157 and the various operative components 159 are discussed in greater detail below. A divider 160 separates the first chamber 156 and the second chamber 158 within the elongate member 14. The divider 160 may be formed as part of the elongate member 14 and may contain voids, openings, or other conduits to allow for electrical and other connections across the divider 160 between the power source 157 and the operative component 159. One or more control buttons 162 are contained on a control cap 166, to control the various operative components 159. The control cap 166 may be removed to access the first chamber 156, change the power source 157, etc.

Additionally, the elements that control the various deterrents in the instant invention are well protected from accidental discharge, or discharge by a subject, due to the configuration of the baton. For example, some prior art devices include all control buttons on top of the handle. Buttons in this location, however, are exposed to a possible strike by a subject during a close-quarters struggle, or even inadvertently by the user while deploying the device (by an inadvertent strike against the thigh, for example). Instead, in the disclosed baton 10, the control elements 120 for the electrodes 30, lights 36, 38, and other features that are located on the operational end 26 of the baton 10 are located on the control end 24 of the baton 10. This control end 24, during use, is usually located below a user's forearm as the baton 10 is gripped. In this way, the control elements 120 are protected and accessible only to the user. Additionally, the actuator 110 for the spray deterrent is only accessible from a rear portion of the top of the handle 12, which again is directed toward the user. The guard 100 prevents access to the actuator 110 from the front portion of the handle 12, and also prevents inadvertent discharge of the spray deterrent if the guard 110 is contacted by a subject.

The spray deterrent is projected in a direction substantially parallel to the axis A of the elongate member, towards the operational end 26 of the baton 10, and away from the user. Use of a non-flammable propellant for the spray discharge prevents ignition of the spray deterrent by the waveform electrodes 30, when the electrodes 30 are energized. The spray deterrent also has a discharge pattern that is oriented to prevent contact of the spray deterrent with the electrodes 30. In one embodiment, the spray deterrent is contained within a canister that can discharge the spray as a narrow stream about 20 feet in length. Other embodiments are also contemplated. One such spray canister is manufactured by Guardian Protective Devices, Inc., of West Berlin, N.J., as product no. FT00CS.

Figure 10:
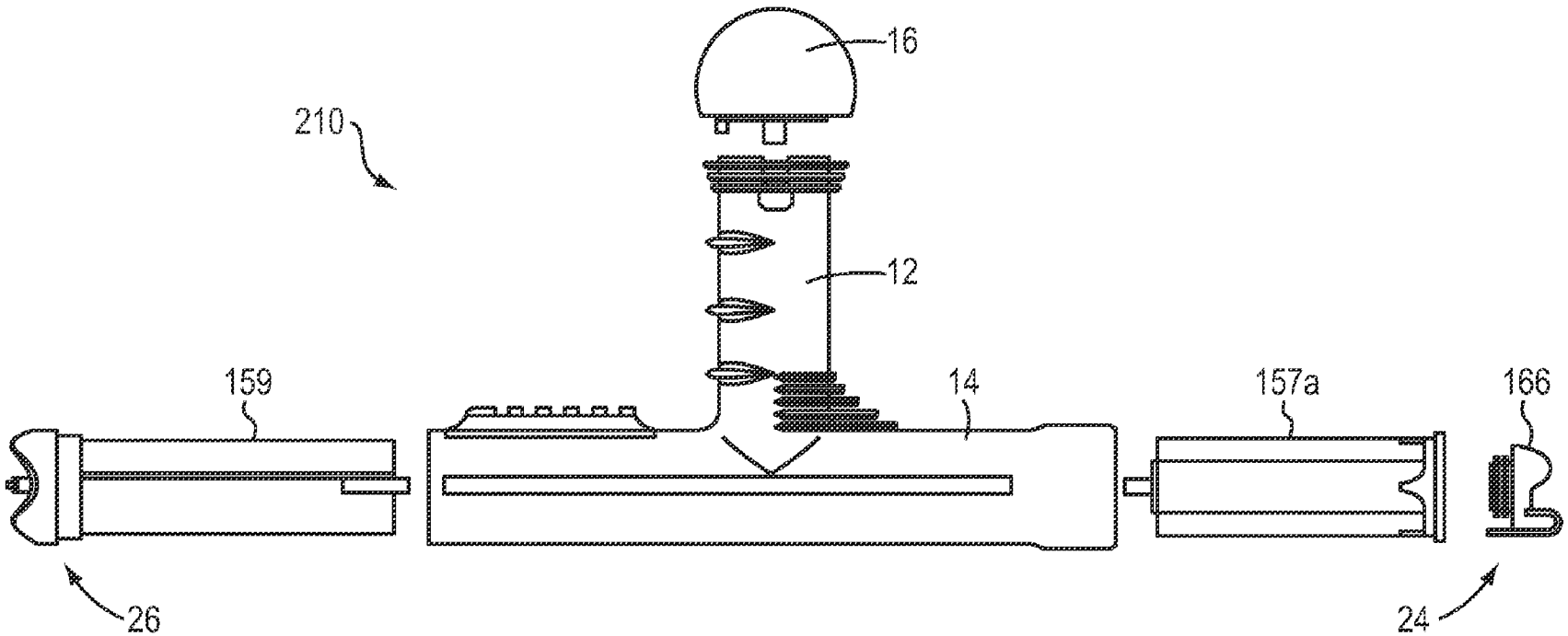
FIG. 10 is a side exploded view of the baton in accordance with one embodiment of the present invention.

FIG. 10 depicts an exploded side view of a modular baton 210 in accordance with one embodiment of the invention. The baton 210 includes many of the components of the baton described above, including the handle 12, the elongate body 14, the cap 16, and the control cap 166, each as previously described. The baton 210 also includes one or more interchangeable operative components 159, as well as a power source housing 157*a* that may also be removable from the elongate member 14. Interchangeable power source housings may be utilized to accommodate different power sources, as desired to power the interchangeable operative components. In an exemplary embodiment of the modular baton 210, however, the same power source (i.e., battery) may be used for any of the interchangeable operative components 159. In such an embodiment, inverters, converters, or other means for converting an electrical signal from the power source to an electrical signal usable by the operative component are contained in each operative component.

Figure 11:
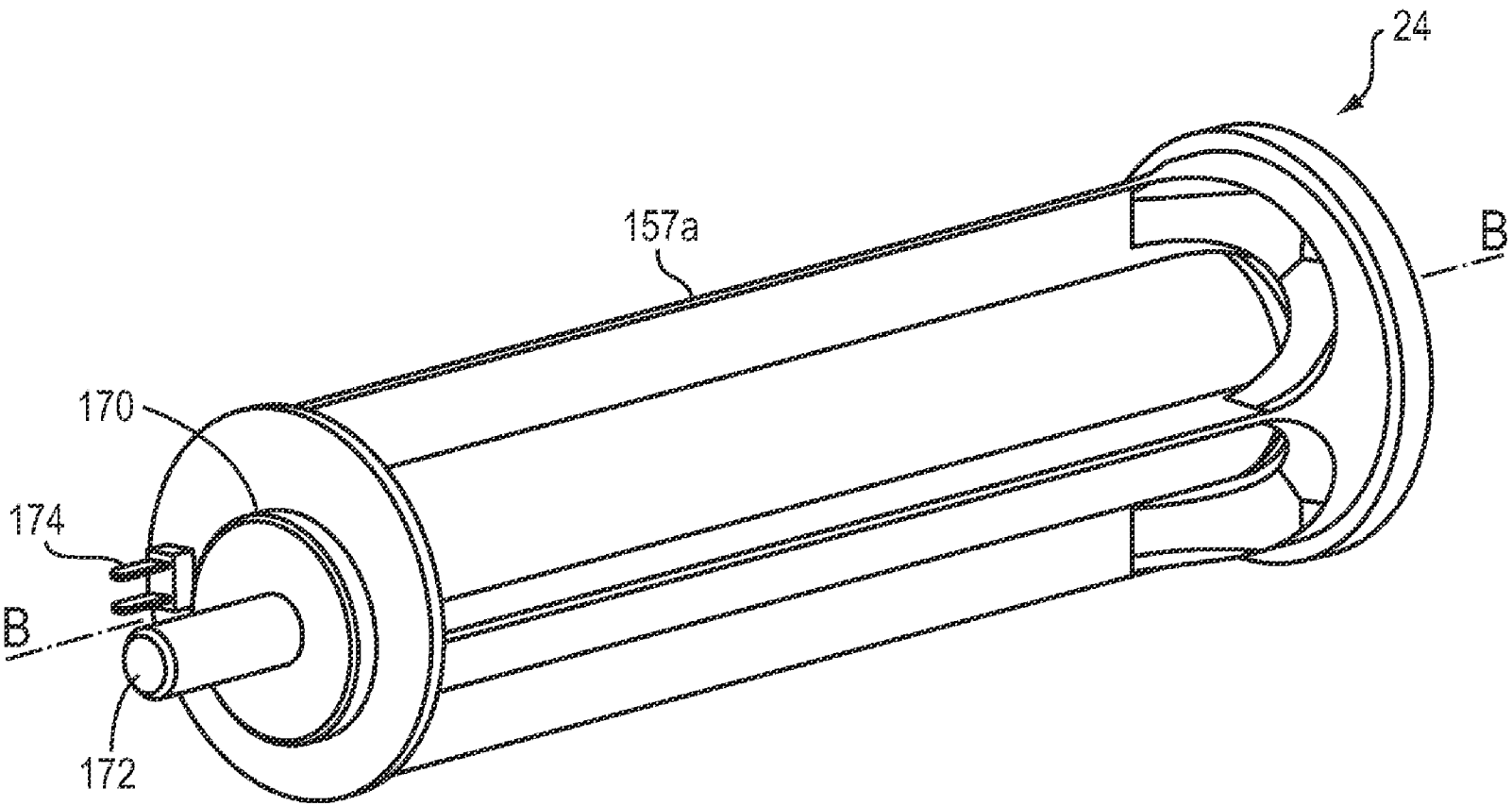
FIG. 11 is a rear perspective view of a power source housing in accordance with one embodiment of the present invention.

The power source housing 157*a*, as shown in FIG. 11, may define a substantially cylindrical shape configured to fit within the first chamber 156 of the elongate member 14. At a distal end opposite the control end 24, the power source housing 157*a* includes an orienting feature 170, a connecting projection 172, and an electrical connector 174. The orienting feature 170 may be circular or other shape to mate with a corresponding depression in the divider 160. In the depicted embodiment, the circular orienting feature 170 is off-axis from an axis B of the power source housing 157*a*. Alternative embodiments of the orienting feature are contemplated, such as a longitudinal groove in the power source housing 157*a* that mates with a projection within the first chamber 156. Use of the orienting feature 170 helps ensure that the connecting projection 172 and the electrical connector 174 extend through the divider 160 at the proper points to mate with the operative component 159. The connecting projection 172, in addition to orienting the power source housing 157*a*, may also be used to provide additional control to the operative component 159. In other embodiments, the connecting projection may be a screw, bolt, or other fastener accessed from the interior of the power source housing 157*a*. In such a case, the connecting projection 172 may be screwed through the divider 160 to a mating structure on the operative component 159. Additional connecting methods may be incorporated, such as a press-fit or other connections. The electrical connector 174 transfers power, control, and other electrical signals from the power source 157 to the operative component 159. In one embodiment, the electrical connector 174 may be a male plug. In other embodiments, the electrical connector 174 may be an alternate form, such as an electrically chargeable metallic element (e.g., a spring).

Figure 12A:
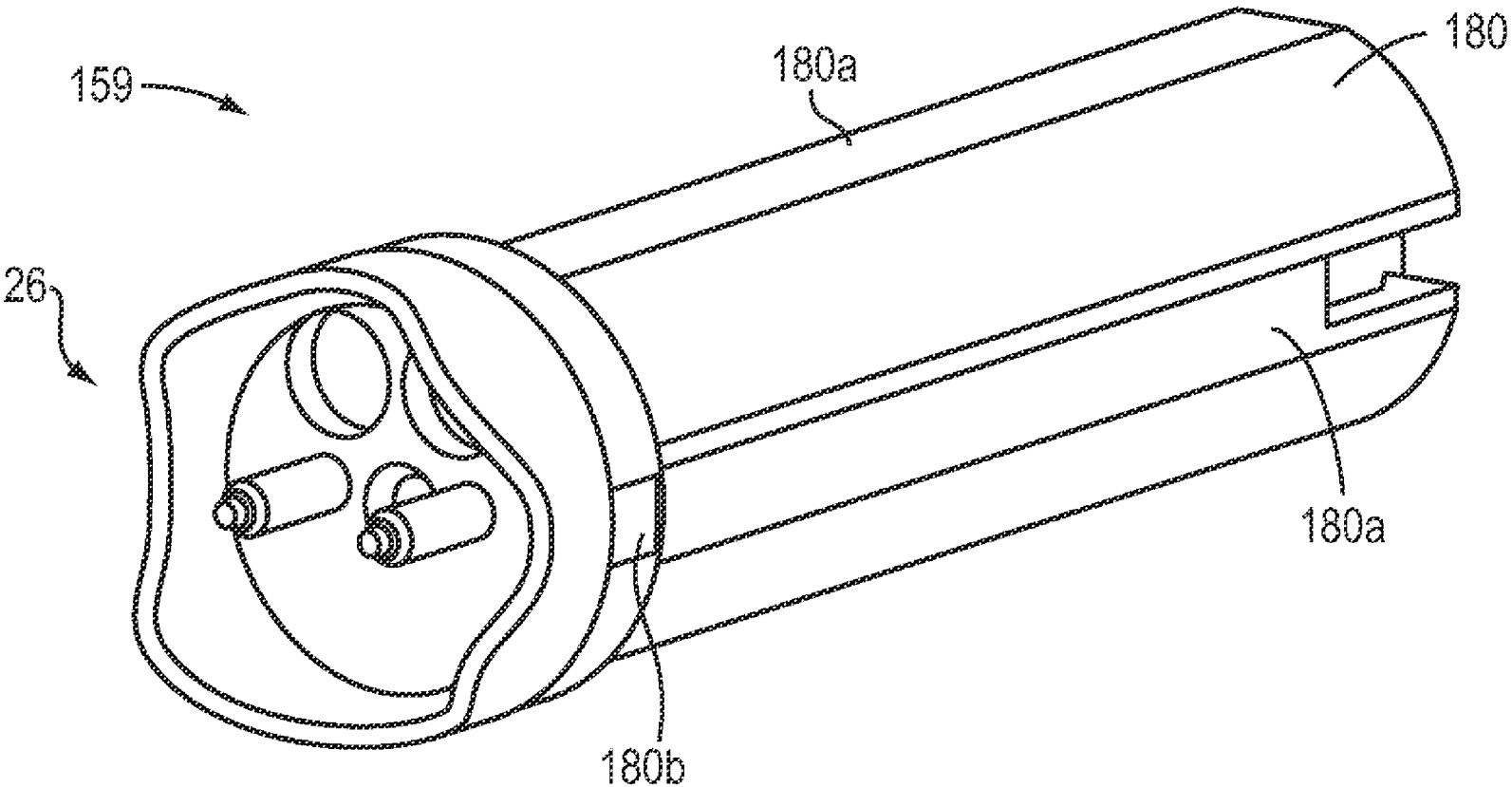
FIGS. 12A and 12B are front and rear perspective views of an operative component in accordance with one embodiment of the present invention.
Figure 12B:
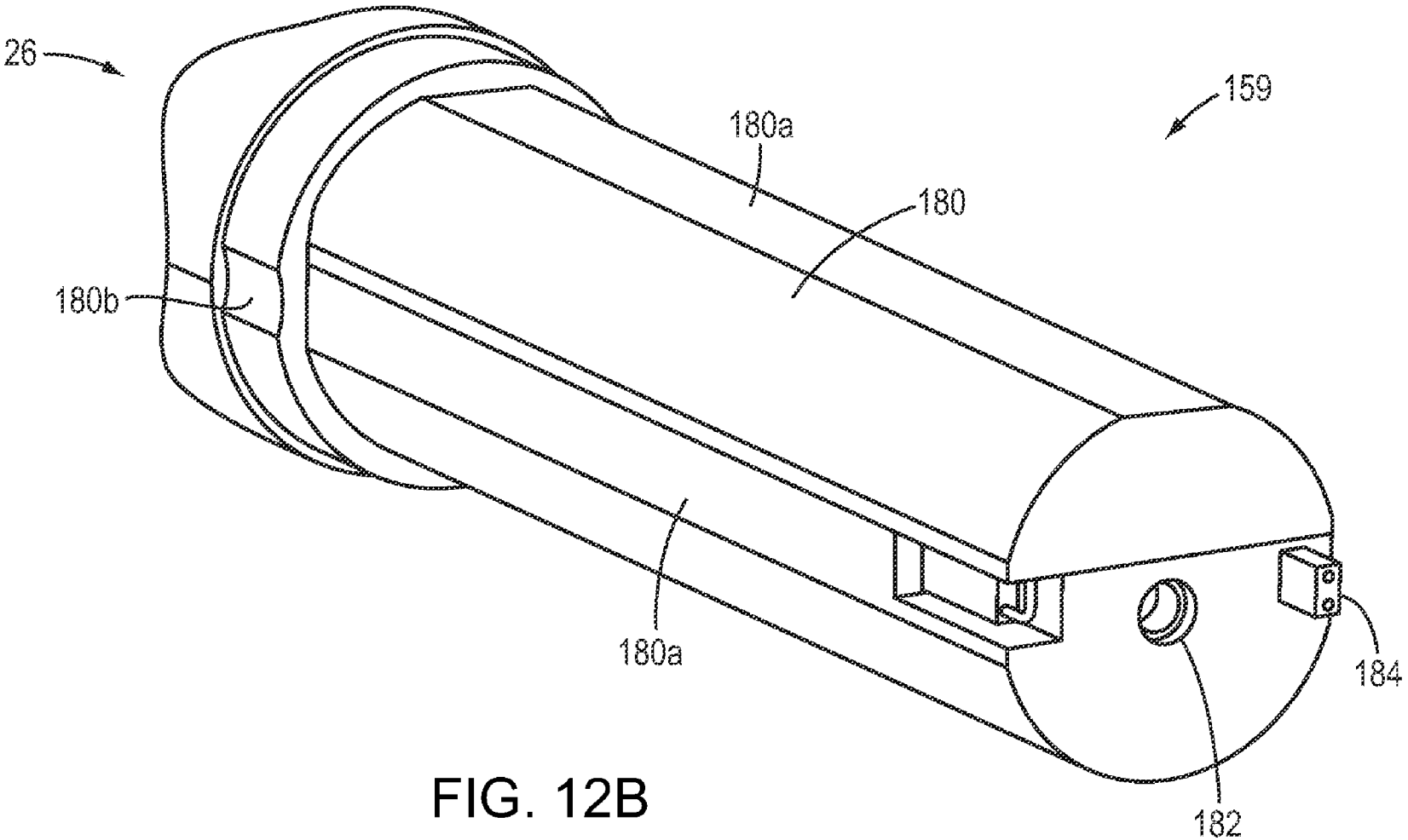

One embodiment of the operative component 159 is shown in FIGS. 12A and 12B. The operative component includes a housing 180, one or more orienting features 180*a*, 180*b*, a connecting element 182, and an electrical connector 184. The housing 180 may define a substantially cylindrical shape and contain the various deterrent options described herein. Various operative components 159 with varying device configurations may be used with the same baton 210 as long as the exterior dimensions of the housing 180 fit within the second chamber 158. As described above, the device configurations may include one or more of light, laser, sound emitters, waveform generators, etc. Additionally, "dummy" or training modules containing no such devices may be used for training or other purposes. One or more orienting features 180*a*, 180*b* may be provided. In one embodiment, substantially flat surfaces 180*a* are utilized on three sides of the cylindrical housing 180 and semi-circular indentations 180*b* are utilized proximate the operational end 26. The housing 180 will fit in the second chamber 158 only when the orienting features 180*a*, 180*b* align with protrusions or other structures in the second chamber 158. Other orienting features, such as a groove and mating projection, are also contemplated.

A connecting element 182 may be formed in a distal end of the operative component 159 opposite the operational end 26. In one embodiment, the connecting element 182 may be a threaded hole to accept a screw, bolt, or other fastener extending through the divider 160. Other connecting elements, such as a cutout to accept a flange for a press-fit connector, may be used. The operative component 159 is powered via the electrical connector 184 that connects to the power source 157. In one embodiment, the electrical connector 184 is a female plug. In other embodiments, the electrical connector may be a conductive metallic element (e.g., a metal plate) configured for contacting a metallic source coupled to the power source 157. Alternative electrical connectors are also contemplated. For example, each of the operative component and power source housings may include a conductive projection (e.g., a spring). Both springs may contact a conductive element within the divider (e.g., metal plates, conductive rubber, etc.) to provide the necessary connection between both elements.

In the embodiment described above, the baton 210 may contain any combination of deterrent elements in the operative component 159, depending on the described use of the baton 210 by a user. In one embodiment, the operative component 159 is a waveform generator in a distal end of the elongate member 14. The waveform generator may be for generating a pulsed, low-power electric waveform having a frequency and over a time period sufficient to induce involuntary muscular contraction with non-injurious muscle effects. Such a waveform generator is disclosed in U.S. Patent Application Publication No. 2007/0167241, the disclosure of which is hereby incorporated by reference herein in its entirety. Similarly, one or more of the LEDs may be replaced with an infrared LED to allow for reading of maps without detrimental effects on a user's night vision. Additionally, the spray deterrent canister 150 may be removed entirely, which allows the handle 12 to be utilized for storage of small articles (with use of a closed cap to seal the handle).

Figure 13A:
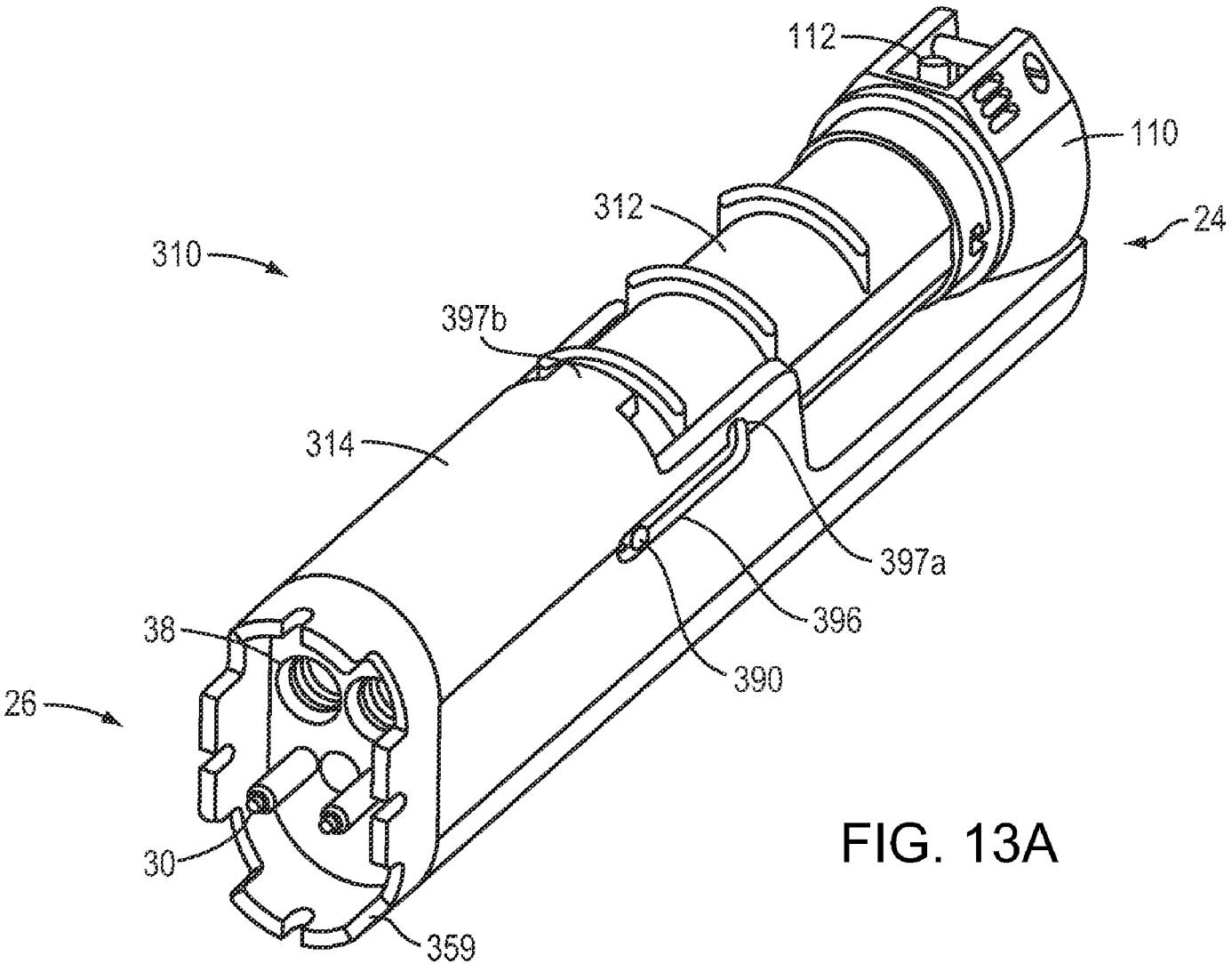
FIGS. 13A and 13B are perspective views of a baton in a deployed and a stored position, respectively, in accordance with another embodiment of the invention.
Figure 13B:
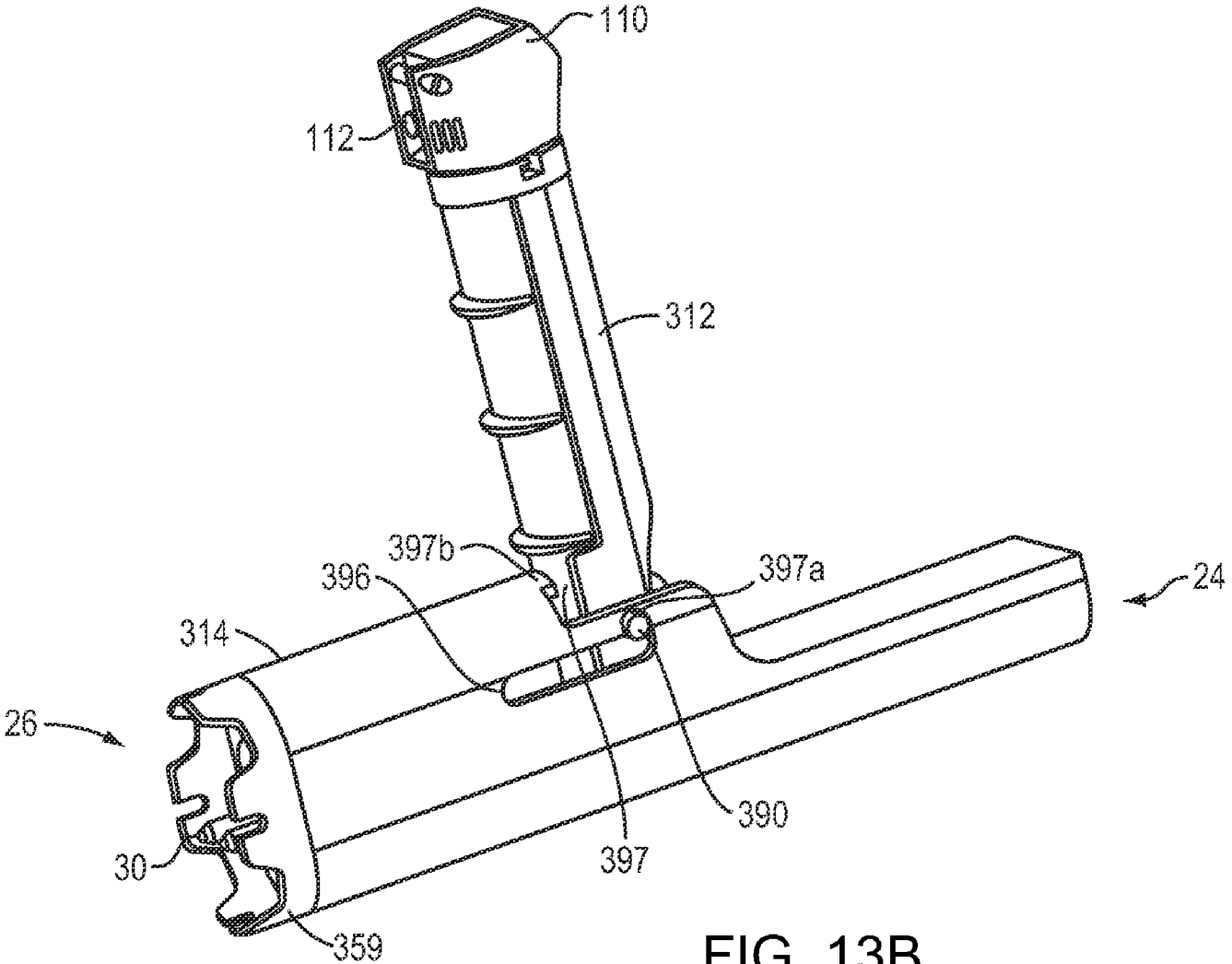
Figure 14:
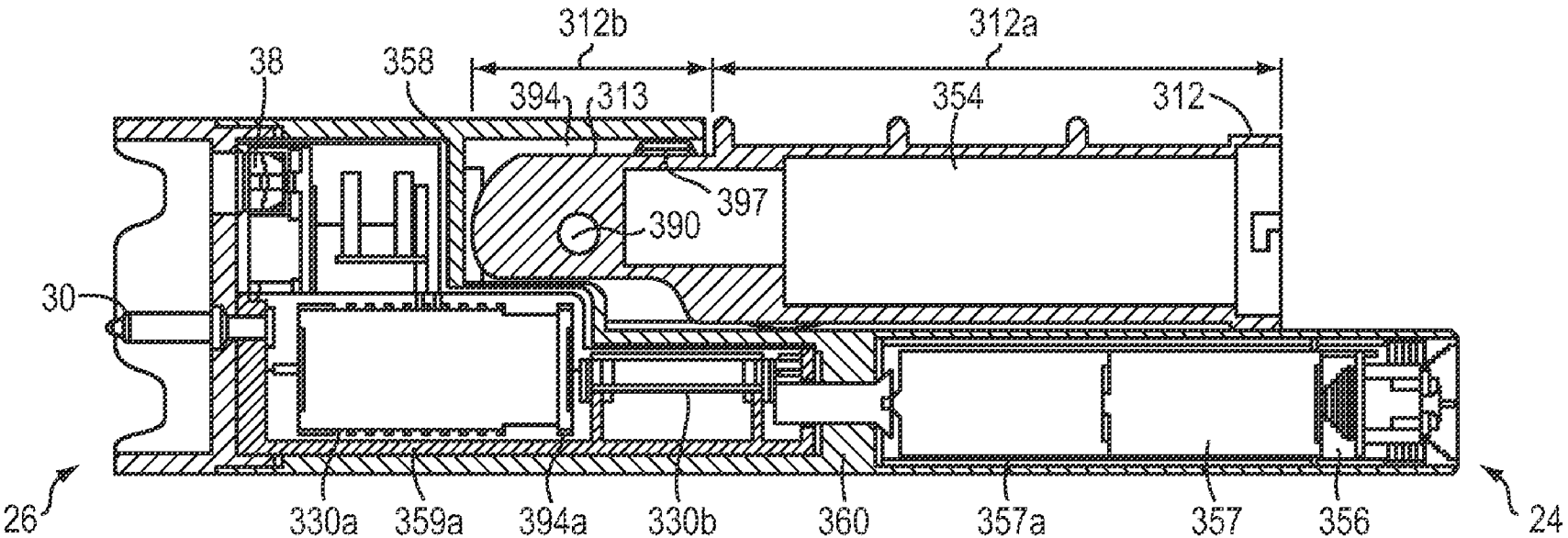
FIG. 14 is a side sectional view of the baton of FIG. 13A.

In another embodiment, depicted in FIGS. 13A, 13B, and 14, a collapsible baton 310 includes a movable handle 312 and an elongate body 314 connected by a pivot mechanism or pivotable connection 390. The movable handle 312 is configured to receive a spray deterrent canister and includes an actuator 110 and a nozzle 112 as described above. In one embodiment, the pivotable connection 390 includes a substantially cylindrical bar or guide pin extending through the movable handle 312 proximate an end of the handle 312. The pivot mechanism 390 engages with a track 396. In one embodiment, the movable handle 312 generally includes two differently shaped portions: a substantially cylindrical portion 312*a* extending for part of the length of the movable handle 312, and a substantially rectangular portion 312*b* for the remaining part of the length. The rectangular portion 312*b* defines a smaller cross-section than the cylindrical portion 312*a*, minimizing the volume needed for storage of the movable handle 312. The rectangular portion 312*b* also provides a flat surface 313 for abutting flush against the elongate member 314 when the movable handle 314 is in the deployed position. The flat surface 313 may include a locking contact surface 397 in the form of raised portions on the movable handle 314. The locking contact surface 397 is configured to interact with one or more locking mechanisms on the elongate member 314, as will be described below.

The elongate member 314 is configured to include various operative components and a power source, as described above with regard to the embodiment of FIGS. 1-12B, though with different shapes and dimensions. Near the operational end 26, the elongate body 314 has a substantially oval cross section. The control end 24 is considerably smaller, such that when the handle 312 is in the stored position (as depicted in FIG. 13A), the baton dimensions are generally consistent, from the operational end 26 to the control end 24.

As depicted in FIG. 14, the elongate body 314 includes a first chamber 356, a second chamber 358, a divider 360, a handle recess 394, and locking mechanisms 397*a*, 397*b*. The first chamber 356, proximate the control end 24, is substantially semi-circular and is configured to accept a power source housing 357*a* which, in turn, contains a power source 357. The second chamber 358 includes an elongate semi-circular void proximate the divider 360 and a larger void proximate the control end 24, both of which are configured to house a single operative component housing 359*a*, shown in FIG. 15. The power source 357 and the operative component 359 serve similar functions and may include similar components as the power source 157 and the operative component 159 described above. In this embodiment, the power source housing 357*a* and the operative component housing 359*a* are differently dimensioned to fit within the elongate member 314.

Figure 15:
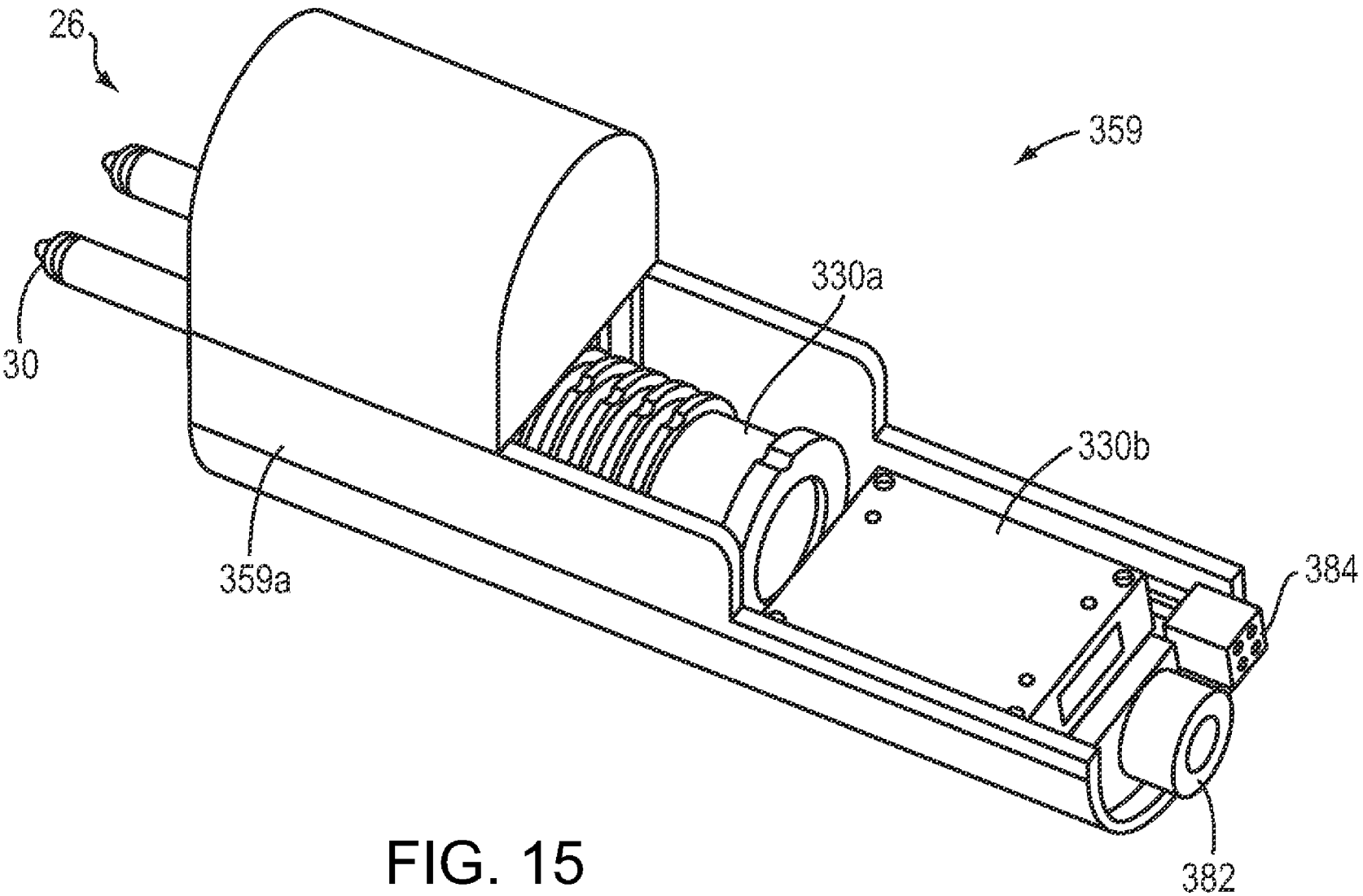
FIG. 15 is a rear perspective view of an operative component in accordance with another embodiment of the invention.

FIG. 15 depicts a rear perspective view of one embodiment of the operative component 359. The operative component 359 depicted includes electrodes 30 connected to a waveform generator 330*a* and a circuit board 330*b* that includes the various control, power conversion, and other circuitry, and also includes strobe lights 38 (depicted in FIG. 14). Physical and electrical connections to the power source 157 may be made through a connecting feature 382 and an electrical connector 310, respectively. All of the components are at least partially contained within the operative component housing 359*a*. The divider 360 separates the first chamber 356 from the second chamber 358 and may include voids, openings, or other gaps therethrough to allow for an electrical connection between the power source 357 and the operative component 359.

Returning to FIGS. 13A, 13B, and 14, an upper portion of the elongate member 314 defines the handle recess 394, the track 396, and the locking mechanisms 397*a*, 397*b*. The handle recess 394 is configured to house a portion of the movable handle 312 when the movable handle 312 is in its stored position. The handle recess 394 may be substantially rectangular with a semi-circular portion corresponding to the shape of the first portion 312*a* of the movable handle 312. The handle recess 394 may include additional features that correspond to the shape of the movable handle 312, such as a raised portion 394*a* proximate the operational end 26, to minimize the space of the elongate member 314 used for the handle recess 394. The track 396 may be formed in opposite sides of the elongate member 314 adjacent to the handle recess 394. In one embodiment, the track 396 is substantially rectangular with rounded edges and is oriented substantially parallel to an axis of the elongate member 314. The track 396 is configured to accept the pivot mechanism 390, and acts as a guide element for the movable handle 312 as the pivot mechanism 390 slides along the track 396. The locking mechanisms 397*a*, 397*b* are used to maintain the movable handle 312 in a deployed position. In one embodiment, the locking mechanism 397*a* is formed by extending a portion of the track 396 toward the top of the elongate member 314. When the movable handle 312 is pulled such that the pivoting mechanism 390 contacts this extended portion of the track 396, the movable handle 312 may be rotated about the pivot mechanism 390 so that an end of the movable handle 312 contacts a surface of the elongate member 314, forcing the pivoting mechanism 390 into the locking mechanism 397*a*. Alternatively or additionally, a spring may project from the bottom of the handle 312, biasing the pivot mechanism 390 into the locking mechanism 397*a*.

The locking mechanism 397*b* is formed by a pair of angled cutouts in a top surface of the handle recess 394. When the movable handle 312 is in the deployed position, the raised portions of the locking contact surface 397 fit into the locking mechanism 397*b*. This interaction creates additional frictional forces that must be overcome to disengage the movable handle 312 from the deployed position. When the movable handle 312 is in the stored position, the locking contact surface 397 contacts an inner surface of the handle recess 394, creating a frictional force that must be overcome by a substantial pulling force to remove the movable handle 312 from the handle recess 394. Additional locking mechanisms are contemplated, such as a ratchet mechanism.

Material utilized in the manufacture of the baton may include plastic, polycarbonate, fiberglass, and related resins, as well as polyester graphite that can be mixed with a wide variety of composite materials with desirable strength and other characteristics as herein disclosed. Suitable composite materials also include polyester/PTFE, polyester/MOS2, blended fiber/graphite, high PV polyimides, polybenzamidizole, PTFE filled PBT, PTFE filled acetal, filled PTFE, solid lubricant filled nylon type 6, aramid fiber filled nylon, PBT, oil and MOs filled nylon type 6, glass reinforced nylon 6,6 (high grade), heat stabilized nylon, and other materials. Such materials are available from St. Gobain Performance Plastics Corporation, of Aurora, Ohio, under the brand names Meldin and Rulon; Ensinger GmbH of Nufringen, Germany, under the brand names Hydex and Hydlar; TriStar Plastics Corp., of Shrewsbury, Mass., under the brand name Ultracomp; Celanese Acetate, LLC, of Dallas, Tex., under the brand name Celazole; Norplex-Micarta, of Postville, Iowa, under the designators R320 and EX350B; and Solvay Advanced Polymers, LLC, of Alpharetta, Ga., under the brand name Torlon. Additionally, construction may include composite materials injection molded over a skeleton, web, or frame of rigid material, such as stainless steel, titanium, fiberglass, Kevlar, etc. The skeleton may be formed, for example, of horizontal and vertical welded stainless steel tendons.

In some of the depicted embodiments, the baton is non-mechanical. The baton body may be molded and/or machined from a single piece of tubular composite material with no moving parts. The composite material has excellent mechanical properties with a high resistance to moisture, cutting, fracture, and rust, and is unlikely to be fouled by extreme hot or cold weather conditions. The composite used in certain embodiments is of sufficient structural strength to obviate the need for any metal in the assembly for support or other structural need. The baton can be made with a wide variety of composites that may approximate or exceed the characteristics of the polyester/graphite composite described.

The baton described herein is easily deployed and used with high speed relative to conventional batons of either traditional or more modern varieties. Due to the high structural strength of the composite utilized in one embodiment, the baton may be smaller than traditional batons, also making the baton easily concealed within and under clothing. The reduced weight and footprint of the baton allow it to be easily worn on a typical duty belt with little fatigue or complication.

As described above, the baton is compatible with use of a variety of other non-lethal devices, particularly with stun devices. The composite is electrically inert, offering little chance of accidental shock due to unintended involvement with stun devices, either in relation to deployment or while holstered. Depending on the precise chemical formulation, the composite may have excellent resistance to solvents, oils used in pepper spray formulations, fire, high heat, marine sea spray, dirt, and high UV exposure (encountered in arid, sunny environments) and may resist shatter, even under cryogenic conditions.

The overall length of the baton may be in the range of about 8 inches to about 24 inches. The handle may have a length in the range of about 3 inches to about 6 inches, and may be located at a midpoint of the elongate member. In alternative embodiments, the handle may be offset from the center of the elongate member. In longer baton embodiments where the handle is offset from the center of the elongate member, it may be desirable that the operational end of the baton be that nearest to the handle. This configuration allows the baton to be used in a manner similar to existing batons, with the control end of the baton located near the user's elbow. Desirable diameters of the elongate member range from about 1 inch to about 2 inches or more. Certain embodiments are approximately 1⅝ inches in diameter. Internal diameters of the elongate member and handle are generally determined based on the clearances required to accommodate batteries, spray canisters, waveform generators, etc. Particularly advantageous wall thicknesses range from about 1/16 inch to about ¼ inch or more. Certain embodiments have walls of approximately ⅛ inch in thickness.

While there have been described herein what are to be considered exemplary and preferred embodiments of the present invention, other modifications of the invention will become apparent to those skilled in the art from the teachings herein. For example, the stun device electrodes can be wired, barbed projectiles optionally shot from the baton to increase effective deterrent range. The particular methods of manufacture and geometries disclosed herein are exemplary in nature and are not to be considered limiting. The disclosed features and functions can be used in various combinations and permutations. It is therefore desired to be secured in the appended claims all such modifications as fall within the spirit and scope of the invention. Accordingly, what is desired to be secured by Letters Patent is the invention as defined and differentiated in the following claims, and all equivalents.

What is claimed is:

1. A baton comprising:

an elongate housing comprising a proximal end and a distal end, the housing defining a first compartment located proximate the proximal end and a second compartment located proximate the distal end; and a power source located in the first compartment, wherein the second compartment is adapted to removably receive interchangeably from the distal end an operative component selected from the group consisting of a training module, a light source, a laser generator, a sound generator, an incapacitation waveform generator, and combinations thereof, wherein the operative component comprises a connection element to secure the operative component within the second compartment, and wherein the connection element is secured with a fastener, wherein the fastener is accessed from the first compartment.

2. The baton of claim 1, further comprising an electrical connection from the first compartment to the second compartment.

3. The baton of claim 2, wherein the power source is connected to the electrical connection and the operative component comprises a contact for contacting the electrical connection.

4. The baton of claim 1, further comprising a divider located between the first compartment and the second compartment, wherein the divider comprises a conductive element selectively connectable to both a power source output and an operative component input.

5. The baton of claim 1, further comprising a removable cap on the distal end, wherein removal of the cap provides access to the power source.

6. The baton of claim 5, wherein the cap comprises a control button for controlling the operative component.

7. The baton of claim 1, further comprising:

a handle substantially orthogonal to the elongate housing, the handle comprising:

a handle housing;

a cap secured to a top of the handle housing; and a spray deterrent canister located within the handle housing and substantially covered by the cap.

8. A baton comprising:

an elongate member comprising:

a housing comprising an axis, a proximal end, and a distal end, wherein the housing defines a first chamber located proximate the proximal end and a second chamber located proximate the distal end;

a divider separating the first chamber and the second chamber;

a conductive element located on the divider, wherein the conductive element comprises at least one of a metal plate and a conductive rubber;

a power source comprising a contact for selective connection to the conductive element when the power source is installed within the first chamber, wherein the contact comprises at least one of a metal projection and a spring;

an electric waveform generator located at least partially within the housing, wherein the electric waveform generator comprises a contact for selective connection to the conductive element when the electric waveform generator is installed within the second chamber, and wherein the contact comprises at least one of a metal projection and a spring;

at least one discharge electrode located proximate the distal end and operatively connected to the electric waveform generator; and a control element located proximate the proximal end, the control element adapted to control the electric waveform generator; and a handle substantially orthogonal to the elongate member, the handle comprising:

a housing;

a cap secured to a top of the housing; and a spray deterrent canister located within the housing and substantially covered by the cap during both actuation and non-actuation of the spray deterrent canister, the spray deterrent canister comprising a non-flammable spray deterrent.

9. The baton of claim 8, wherein the elongate member further comprises at least one of a laser and a light proximate the distal end.

10. The baton of claim 8, wherein the light comprises at least one of a constant beam and a strobe.

11. The baton of claim 8, wherein the elongate member further comprises a picatinnay rail.

12. The baton of claim 8, wherein the electric waveform generator comprises a circuit for generating a pulsed, low-power electric waveform having a frequency and over a time period sufficient to induce involuntary muscular contraction with non-injurious muscle effects.

* * * * *